US010704846B2

(12) United States Patent
Alahyari et al.

(10) Patent No.: US 10,704,846 B2
(45) Date of Patent: Jul. 7, 2020

(54) HYBRID METAL-POLYMER HEAT EXCHANGER

(71) Applicant: Hamilton Sundstrand Corporation, Charlotte, NC (US)

(72) Inventors: Abbas A. Alahyari, Glastonbury, CT (US); Craig R. Walker, S. Glastonbury, CT (US); Scott Alan Eastman, Glastonbury, CT (US); Catherine Thibaud, South Windsor, CT (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 0 days.

(21) Appl. No.: 15/620,433

(22) Filed: Jun. 12, 2017

(65) Prior Publication Data

US 2018/0356169 A1 Dec. 13, 2018

(51) Int. Cl.
*F28F 21/06* (2006.01)
*F28D 1/053* (2006.01)
(Continued)

(52) U.S. Cl.
CPC ..... *F28F 21/062* (2013.01); *F28D 1/05316* (2013.01); *F28D 1/05383* (2013.01); *F28F 1/12* (2013.01); *F28F 1/126* (2013.01); *F28F 1/325* (2013.01); *F28F 21/067* (2013.01); *F28F 21/081* (2013.01); *F22B 37/101* (2013.01); *F28D 1/053* (2013.01); *F28D 1/0535* (2013.01); *F28D 7/0041* (2013.01); *F28F 1/32* (2013.01); *F28F 3/022* (2013.01); *F28F 13/185* (2013.01); *F28F 2215/00* (2013.01); *F28F 2215/04* (2013.01); *F28F 2215/06* (2013.01); *F28F 2245/04* (2013.01); *F28F 2255/06* (2013.01); *F28F 2260/02* (2013.01); *F28F 2275/025* (2013.01); *F28F 2275/10* (2013.01); *F28F 2275/127* (2013.01)

(58) Field of Classification Search
CPC .. F28F 21/062; F28F 2215/00; F28F 2215/06; F28F 2215/04; F28F 1/12; F28F 1/126; F28F 1/325; F28F 3/022; F28D 1/05316; F28D 1/05383; F22B 37/101
USPC ..... 165/104.17, 133
See application file for complete search history.

(56) References Cited

U.S. PATENT DOCUMENTS 3,962,766 A 6/1976 Pompidor et al.
5,945,217 A * 8/1999 Hanrahan ..... H01L 23/4275 165/104.17
(Continued)

FOREIGN PATENT DOCUMENTS

DE 1014570 B 8/1957
EP 2718634 A2 4/2014
(Continued)

OTHER PUBLICATIONS

Extended European Search Report for EP Application No. 18167046.4, dated Nov. 9, 2018, pp. 9.

*Primary Examiner* — Joel M Attey
(74) *Attorney, Agent, or Firm* — Kinney & Lange, P.A.

(57) ABSTRACT

A heat exchanger includes a metal tube and a composite polymer fin in thermal contact with the metal tube. The fin is formed of a polymer and a thermally conductive filler such that the fin has a thermal conductivity greater than or equal to 0.5 Watts per meter Kelvin.

18 Claims, 6 Drawing Sheets

(51) Int. Cl.

| | |
|---|---|
| ***F28F 1/12*** | (2006.01) |
| ***F28F 1/32*** | (2006.01) |
| ***F28F 21/08*** | (2006.01) |
| *F28F 13/18* | (2006.01) |
| *F28D 7/00* | (2006.01) |
| *F22B 37/10* | (2006.01) |
| *F28F 3/02* | (2006.01) |

(56) References Cited

U.S. PATENT DOCUMENTS

| | | | | |
|---|---|---|---|---|
| 6,377,219 | B2 | 4/2002 | Smith | |
| 6,926,070 | B2 | 8/2005 | Jenkins et al. | |
| 6,983,789 | B2 * | 1/2006 | Jenkins | F28F 1/32 165/104.33 |
| 9,599,328 | B2 | 3/2017 | Koplow | |
| 2003/0183371 | A1 | 10/2003 | Zeighami et al. | |
| 2004/0261983 | A1 * | 12/2004 | Hu | F28D 1/0443 165/148 |
| 2007/0284095 | A1 | 12/2007 | Wang et al. | |
| 2008/0030957 | A1 * | 2/2008 | Abul-Haj | F28F 3/02 361/703 |
| 2010/0043230 | A1 | 2/2010 | Bhatti | |
| 2010/0181051 | A1 * | 7/2010 | Huang | F28F 13/185 165/133 |
| 2012/0067548 | A1 * | 3/2012 | Tun | F28D 7/16 165/104.11 |
| 2013/0048257 | A1 | 2/2013 | Perry | |
| 2018/0094583 | A1 * | 4/2018 | Carretero Benignos | F28D 1/0471 |

FOREIGN PATENT DOCUMENTS

| | | | |
|---|---|---|---|
| EP | 2966392 | A1 | 1/2016 |
| FR | 1032286 | A | 6/1953 |
| JP | 2004239600 | A | 8/2004 |
| JP | 2005030677 | A | 2/2005 |
| WO | WO2016019303 | A1 | 2/2016 |

* cited by examiner

HYBRID METAL-POLYMER HEAT EXCHANGER

STATEMENT OF GOVERNMENT INTEREST

This invention was made with government support under DE-EE0005775 awarded by Department of Energy. The government has certain rights in the invention.

BACKGROUND

The present disclosure relates generally to heat exchangers, and in particular, to a heat exchanger utilizing fins.

Heat exchangers may use a variety of different technologies or configurations, such as fin and tube technology or plate and fin technology. Heat exchangers use such technologies or configurations to exchange or transfer heat from a first fluid to a second fluid. The heat exchange between the fluids takes place as the fluids flow through the heat exchanger. Increasing the surface area between the first fluid and the second fluid can increase heat exchange. Fins may be utilized to increase the surface area between the fluids. Fins are often made of metal so that they have a high thermal conductivity and thus a higher rate of heat transfer. Metal fins can be heavy and expensive.

SUMMARY

A heat exchanger includes a metal tube and a composite polymer fin in thermal contact with the metal tube. The fin is formed of a polymer and a thermally conductive filler such that the fin has a thermal conductivity greater than or equal to 0.5 Watts per meter Kelvin.

A heat exchanger includes a plurality of metal tubes and a plurality of composite polymer fins in thermal contact with the metal tubes. The fins are formed of polymer and a thermally conductive filler such that the fin has a thermal conductivity greater than or equal to 0.5 Watts per meter Kelvin.

DETAILED DESCRIPTION

A tube and fin heat exchanger has metal tubes and composite polymer fins made up of a polymer and a thermally conductive filler. The composite polymer fins are inherently corrosion-resistant and reduce the weight and cost of the heat exchanger while maintaining fluid compatibility, mechanical strength, and high thermal conductivity.

Figure 1A:
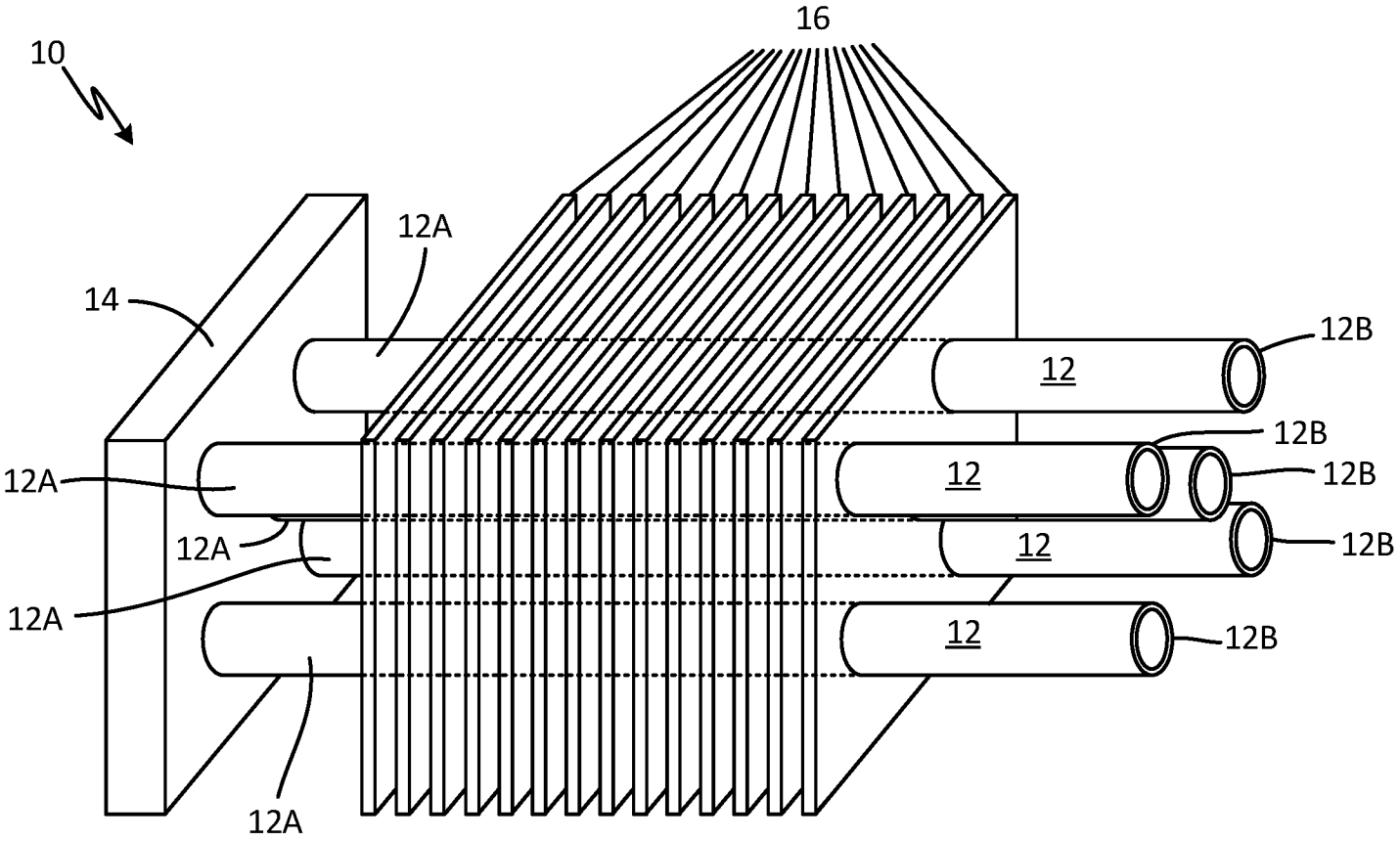
FIG. 1A is an isometric view of a first embodiment of a heat exchanger.
Figure 1B:
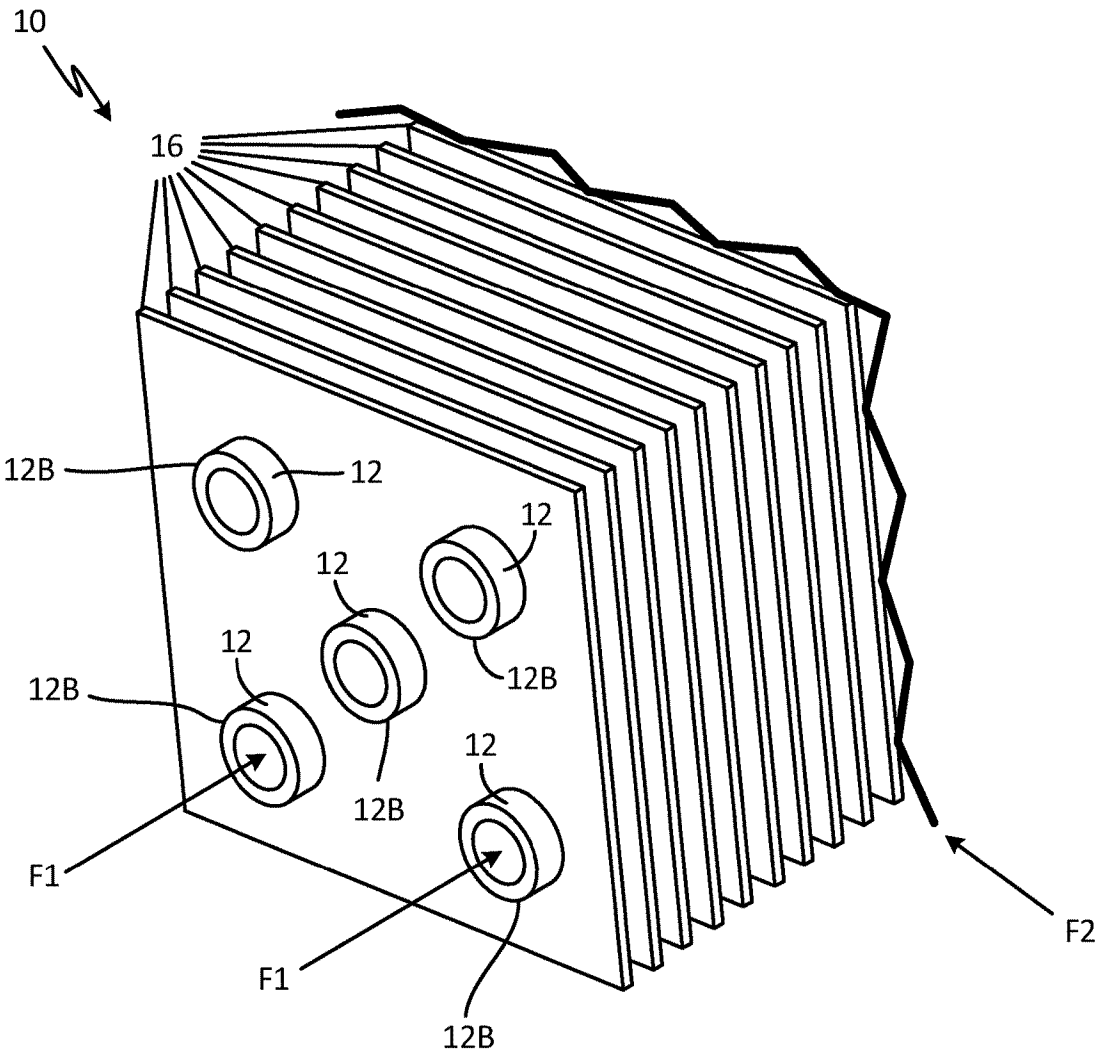
FIG. 1B is a partial isometric view of the first embodiment of the heat exchanger.

FIG. 1A is an isometric view of a first embodiment of heat exchanger 10. FIG. 1B is a partial isometric view of the first embodiment of heat exchanger 10. FIGS. 1A and 1B will be discussed together. Heat exchanger 10 includes tubes 12, having first ends 12A (shown in FIG. 1A) and second ends 12B, header 14 (shown in FIG. 1A), and fins 16. Also shown in FIG. 1B is a first fluid flow F1 and a second fluid flow F2.

Each tube 12 has a first end 12A and a second end 12B. First ends 12A of tubes 12 are attached to header 14. Tubes 12 are spaced from and parallel to each other. Tubes 12 are annular and hollow. Tubes 12 are metal and may have a hydraulic diameter between about 0.2 millimeter (mm) and about 2.0 mm. In the embodiment shown, heat exchanger 10 has five tubes 12. In alternate embodiments, heat exchanger 10 may have any number of tubes 12. Header 14 receives first ends 12A of tubes 12 such that tubes 12 are in fluid communication with an interior of header 14. Header 14 may be made of and attached to tubes 12 by a heat shrinkable polymer. A first fluid (not shown), such as a refrigerant, is contained within the interior of header 14. Tubes 12 extend from header 14 through fins 16, such that fins 16 are located between first ends 12A and second ends 12B of tubes 12. Fins 16 are attached to tubes such that fins 16 are in thermal contact with tubes 12. Fins 16 are flat sheets and are arranged spaced from and parallel to each other and orthogonal to tubes 12. Heat exchanger 10 may have any number of fins 16. Fins 16 are made of a thermally conductive composite polymer. As such, fins 16 have a thermal conductivity of at least about 0.5 Watts per meter Kelvin, preferably at least about 2.0 Watts per meter Kelvin, and more preferably at least about 5.0 Watts per meter Kelvin. Fins 16 may be formed through molding, extrusion, thermal forming, or pressing. Fins 16 may also be formed through 3-D printing. In alternate embodiments, fins 16 may be embossed, perforated, punched, or textured by thermoforming to enhance heat transfer. A second fluid (not shown), such as air, is located between fins 16 and around tubes 12.

Fins 16 may be attached to tubes 12 by adhesive bonding. The adhesive may be epoxy, urethane, acrylate, silicone, rubber, phenolic based adhesive, or any other suitable material that bonds or joins metals and polymers. The adhesive may be curable by UV light, oxygen, heat, or any other appropriate stimuli. Fins 16 may also be attached to tubes 12 by thermoplastic force, chemical bonding, or pressure fitting. Additionally, fins 16 may be attached to tubes 12 using elastomeric or heat shrinkable fins 16. Specifically, fins 16 may be elastomeric or heat shrinkable and include pre-punched holes or perforations configured to accept insertion of tubes 12 when fin 16 is prestretched or expanded. As such, tubes 12 can be inserted into the perforations in fins 16 when fin 16 is expanded. Following insertion of tubes 12, strain can be released by either releasing stress of elastomeric fins or applying heat to expanded, heat shrinkable fins 16 to relax locked in residual stress in fins 16 and shrink fins 16 such that fins 16 mechanically seal around tubes 12. Further, fins 16 may be additively deposited onto tubes 12.

The first fluid within header 14 comprises first fluid flow F1, which flows through hollow centers of tubes 12. The fluid in tubes 12 may be a fluid containing heat. As it flows through tubes 12, the first fluid is in contact with tubes 12 and the heat from the first fluid transfers to tubes 12. Subsequently, because fins 16 are in thermal contact with tubes 12 and fins 16 are made of a thermally conductive composite polymer, heat transfers from tubes 12 to fins 16. The more thermally conductive the fin, the more heat transfer occurs. A second fluid comprises second fluid flow F2, which flows around the exterior of tubes 12 and in spaces between fins 16. The second fluid, which contains less heat than the first fluid, is in contact with tubes 12 and fins 16, and the heat transfers from tubes 12 and fins 16 to the second fluid. As such, heat exchanger 10 can be used to transfer heat from a first fluid to a second fluid, thereby cooling the first fluid and heating the second fluid. Fins 16 are used to increase the surface area that is in thermal contact with the first and second fluids.

Figure 2A:
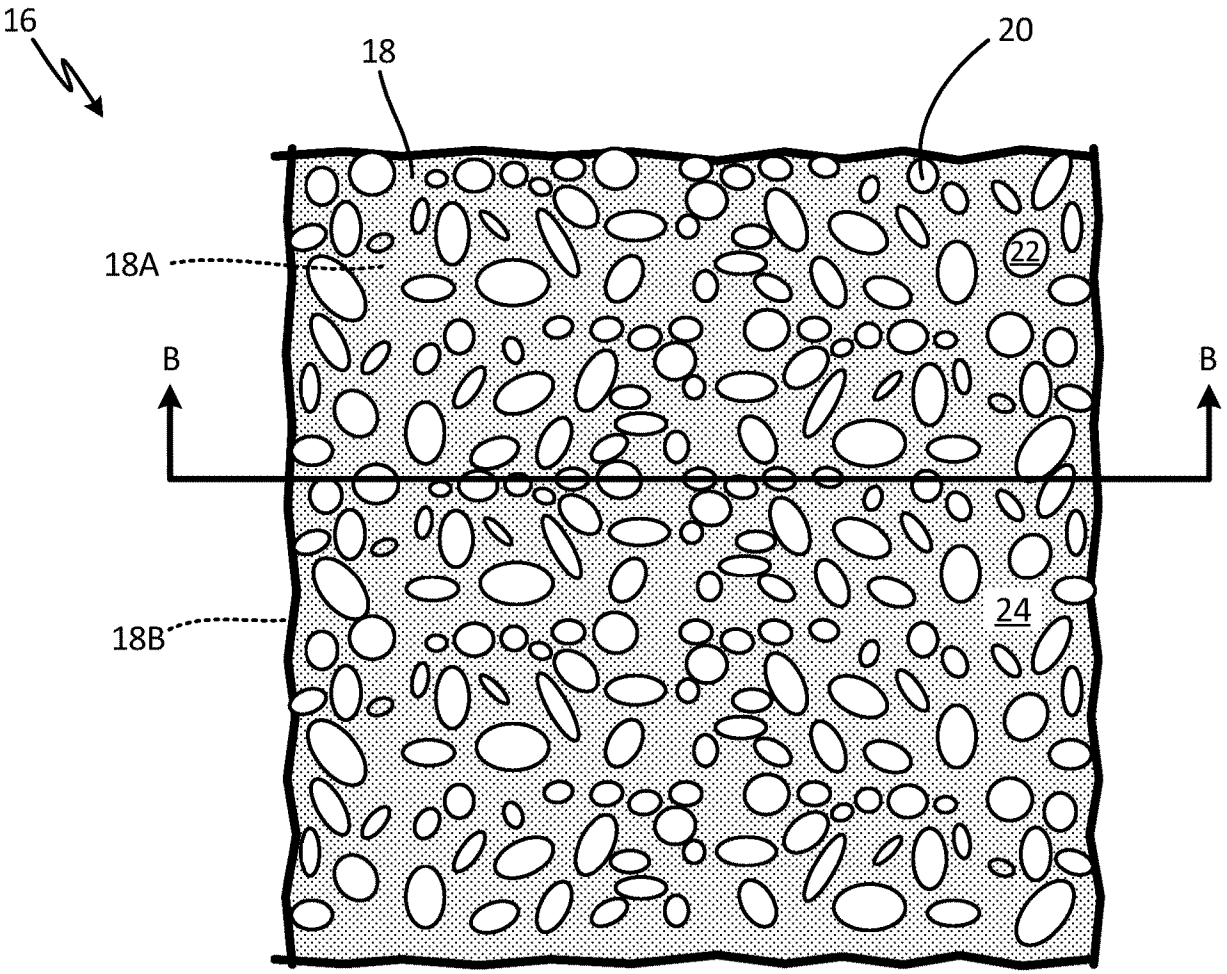
FIG. 2A is an enlarged partial top view of a fin of the heat exchanger.
Figure 2B:
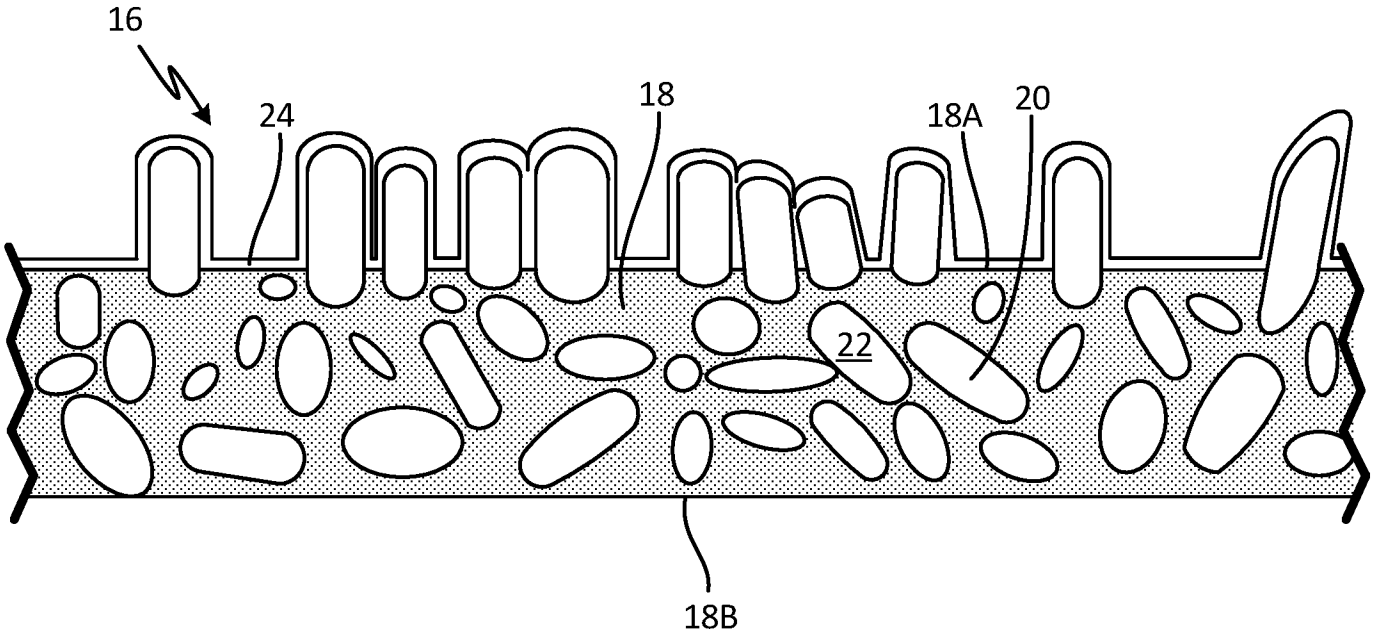
FIG. 2B is an enlarged partial cross-sectional view of the fin taken along line B-B of FIG. 2A.

FIG. 2A is an enlarged partial top view of fin 16 of heat exchanger 10. FIG. 2B is an enlarged partial cross-sectional view of fin 16 taken along line B-B of FIG. 2A. FIGS. 2A and 2B will be discussed together. Fin 16 includes polymer 18, having first surface 18A and second surface 18B, filler 20, which includes particles 22, and coating 24.

Fin 16 is made of polymer 18, which has first surface 18A making up a first surface of fin 16 and second surface 18B making up a second surface of fin 16. First surface 18A and second surface 18B of polymer 18 may be inherently hydrophobic. All surfaces of polymer 18 may also be inherently hydrophobic. Polymer 18 is filled with filler 20. Fin 16 may have a filler 20 concentration greater than 5 weight percent, preferably greater than 15 weight percent, and more preferably greater than 25 weight percent. Filler 20 concentration can be equal to or greater than 50 weight percent. The filler 20 concentration may depend on the orientation of filler 20. Filler 20 is a thermally conductive material or a mixture of thermally conductive materials, and is made up of particles 22. Filler 20 has a thermal conductivity in at least one direction greater than or equal to 2 Watts per meter Kelvin, preferably greater than 5 Watts per meter Kelvin, and more preferably greater than 20 Watts per meter Kelvin. As such, fin 16 has a thermal conductivity of at least about 0.5 Watts per meter Kelvin, preferably at least about than 2.0 Watts per meter Kelvin, and more preferably at least about 5.0 Watts per meter Kelvin. The shape of particles 22 may vary. A plurality of particles 22 of filler 20 protrude partially from first surface 18A of polymer 18. As such a surface area of a portion of each of particles 22 that protrude past first surface 18A of polymer 18 also make up the first surface of fin 16. Any number of particles 22 may protrude past first surface 18A of polymer 18. A post-fabrication etching process can be used to cause particles 22 to protrude past first surface 18A. In alternate embodiments, one or more particles 22 may also protrude past second surface 18B of polymer 18 and/or any other surface of polymer 18. Further, in alternate embodiments, no particles 22 protrude past first surface 18A of polymer 18 such that polymer 18 solely makes up the first surface of fin 16. First surface 18A of polymer 18 is coated with coating 24. Coating 24 may be aluminum, copper, nickel, or any other suitable metallic coating. In alternate embodiments, second surface 18B of polymer and/or any other surface of polymer 18 may be coated with coating 24. Further, in alternate embodiments, fin 16 does not include coating 24.

Polymer 18 may be a rigid thermoplastic polymer, an elastomeric polymer, or any other suitable polymer or copolymer. Polymer 18 may be a rigid thermoplastic polymer such as polypropylene, polyamides such as nylon 6, nylon 6/6, nylon 6/12, nylon 11, nylon 12, and polyphthalamide, polyphenylene sulfide, liquid crystal polymers, polyethylene, polyaryl ether ketones such as polyether ether ether ketone, polyether ether ketone, and polyether ketone ketone, or any other suitable rigid thermoplastic polymer. Polymer 18 may be an elastomeric polymer such as fluoroelastomers, polyvinylidene fluoride, polytetrafluoro ethylene, silicones, fluorosilicones, ethylene propylene diene monomer (EPDM) rubber, polyurethane, or any other suitable elastomeric polymer. Polymer 18 may be a copolymer of the material cited above.

Filler 20 may be graphite, graphene, boron nitride, carbon, carbon nanotubes, carbon fiber, silicon carbide, silicon nitride, other suitable micron or nanoscale materials, or any other suitable material. Filler 20 may also be metal such as aluminum, copper, nickel, or any other suitable metal. Filler 20 may be comprised of several of these materials.

Polymer 18 and filler 20 make up thermally conductive composite polymer fins 16. Filler 20 increases the thermal conductivity of fin 16, which increases heat transfer of heat exchanger 10. Partial protrusion of particles 22 of filler 20 from first surface 18A of polymer 18 increases the surface area of the first surface of fin 16, which also increases heat transfer of heat exchanger 10. Additionally, coating 24 increases thermal conductivity, as well as mechanical strength, of fin 16. Because fin 16 is made up of polymer 18 and filler 20, heat exchanger 10 accomplishes a greater than 50 percent reduction in metal usage for a heat exchanger.

Fins 16 are less corrosive, lighter in weight, and less expensive. Fins 16 are also anti-frost and anti-fouling. At the same time, heat exchanger 10 maintains fluid compatibility, mechanical strength, and high thermal conductivity.

Figure 3:
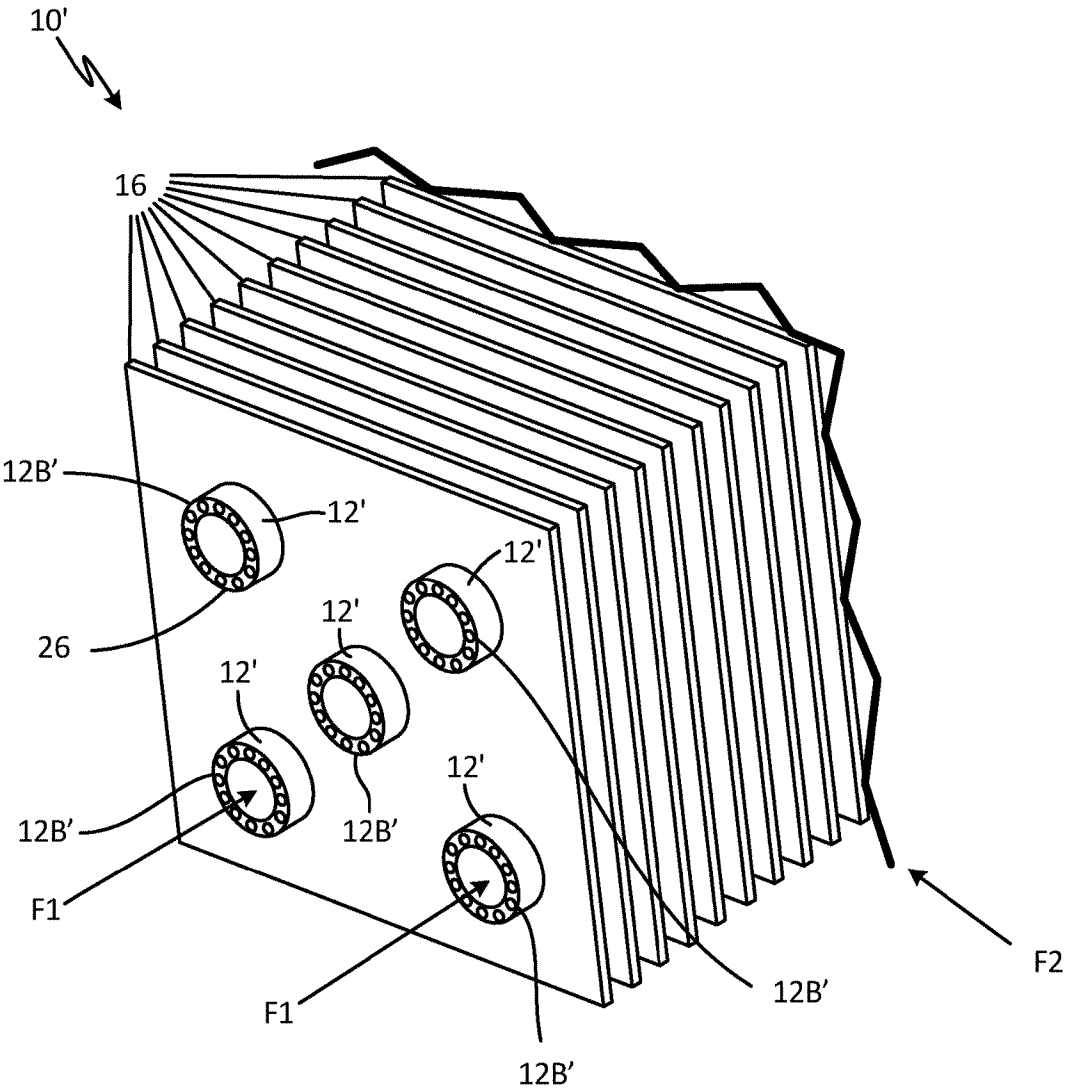
FIG. 3 is a partial isometric view of a second embodiment of a heat exchanger.

FIG. 3 is a partial isometric view of a second embodiment of heat exchanger 10'. Heat exchanger 10' is the same as heat exchanger 10, having similar components functioning in a similar matter, but tubes 12' of heat exchanger 10' have micro tubes 26 extending from first end 12A' (not shown) to second end 12B' of tubes 12'.

Micro tubes 26 are formed within annular hollow tubes 12' between an outer diameter and an inner diameter of tubes 12'. As such, micro tubes 26 are positioned circumferentially around tube 12'. Micro tubes 26 are annular spaces in metal tubes 12'. Micro tubes 26 each have a first end flush with first end 12B' of tube 12' and a second end flush with second end 12A' of tube 12'. Tubes 12' may have any number of micro tubes 26. In alternate embodiments, micro tubes 26 may be any other suitable shape. Further, in alternate embodiments, tubes 12' do not have a hollow annular space in the center and micro tubes 26 may be positioned between an outer diameter of tubes 12'.

The first fluid flows through micro tubes 26, which increases the rate of first fluid flow F1, increasing heat transfer of heat exchanger 10'.

Figure 4:
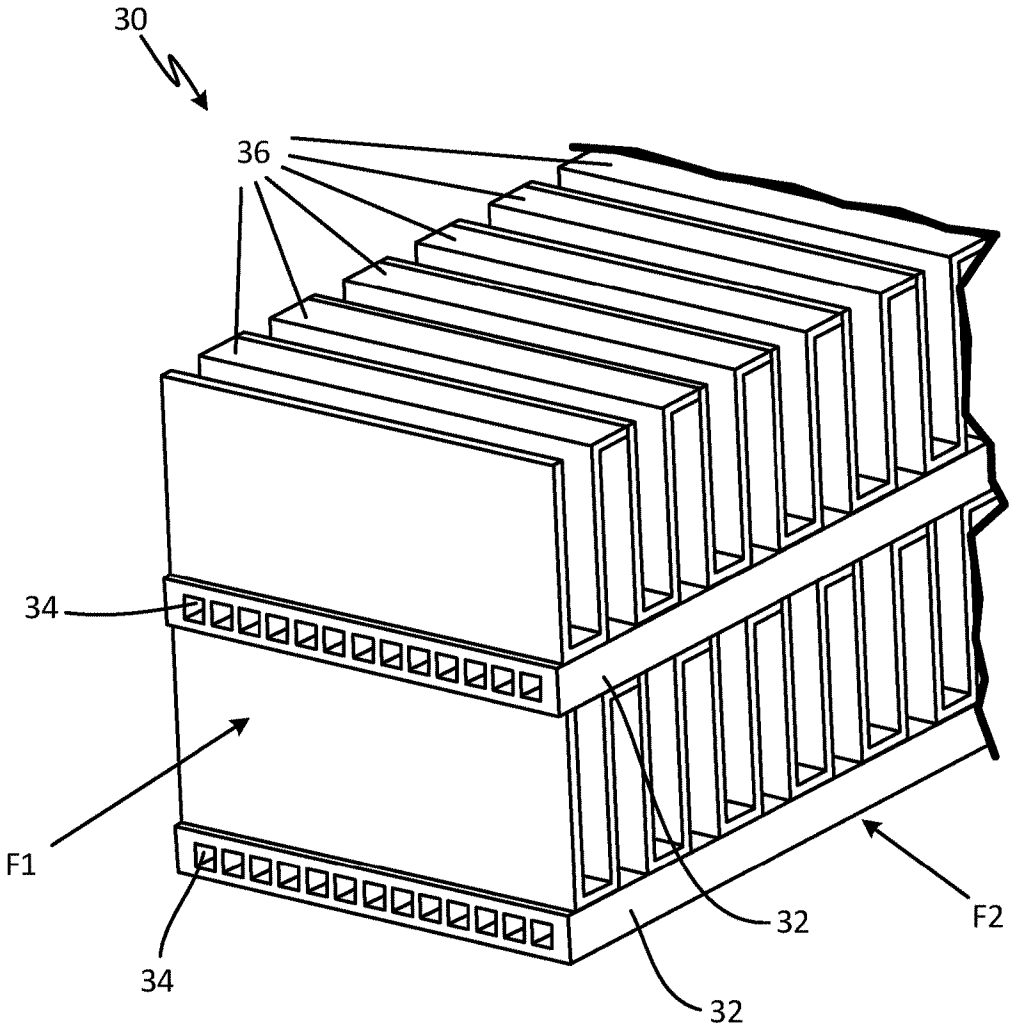
FIG. 4 is a partial isometric view of a third embodiment of a heat exchanger.

FIG. 4 is a partial isometric view of a third embodiment of heat exchanger 30. Heat exchanger 30 includes tubes 32, having microchannels 34, and fins 36. Also shown in FIG. 4 is first fluid flow F1 and second fluid flow F2. Heat exchanger 30 is similar to heat exchanger 10, with fins 36 being made of the same thermally conductive composite polymer, but tubes are flat with microchannels and fins are corrugated and positioned to be in contact with each other.

Tubes 32 are flat and have microchannels 34 extending from first ends of tubes 32 to second ends of tubes 32. Tubes 32 are multiport extrusions. First ends of tubes 32 are attached to a header (as shown and described in reference to FIG. 1A) such that tubes 32 are in fluid communication with an interior of the header, which contains a first fluid (not shown), such as a refrigerant. Each tube 32 may have a hydraulic diameter between about 0.2 mm and about 2.0 mm. Tubes 32 are metal. Heat exchanger 30 may have any number of tubes 32. Microchannels 34 are positioned within tubes 32 parallel to each other. Microchannels 34 have first ends flush with first ends of tubes 32 and second ends flush with second ends of tubes 32. Microchannels 34 are passageways from first ends of tubes 32 to second ends of tubes 32. In this embodiment, microchannels 34 are rectangular. In alternate embodiments, microchannels 34 may be any other suitable shape. Tubes 32 may have any number of microchannels 34.

Fins 36 are positioned on first sides of flat tubes 32 and on second sides of flat tubes 32 such that fins 36 and tubes 32 are stacked in an alternating pattern. Fins 36 are attached to tubes such that fins 36 are in thermal contact with tubes 32. Fins 36 are corrugated and are positioned adjacent each other such that they are in contact with each other. Heat exchanger 30 may have any number of fins 36. Fins 36 are made of the thermally conductive composite polymer as described with reference to FIGS. 2A and 2B. Fins 36 may be formed through molding, extrusion, thermal forming, pressing, or folding. Fins 36 may also be formed through 3-D printing. In alternate embodiments, fins 36 may be embossed, perforated, punched, or textured by thermoforming to enhance heat transfer. A second fluid (not shown), such as air, is located between fins 36.

Fins 36 may be attached to tubes 32 by adhesive bonding. The adhesive may be epoxy, urethane, acrylate, silicone, rubber, phenolic based adhesive, or any other suitable material that bonds or joins metals and polymers. The adhesive may be cured by UV light, oxygen, heat, or any other appropriate stimuli. Fins 36 may also be attached to tubes 32 by thermoplastic force, chemical bonding, or pressure fitting. Further, fins 36 may be additively deposited onto tubes 32.

The first fluid within the header comprises first fluid flow F1, which flows through hollow centers of microchannels 34 in tubes 32. The fluid in tubes 32 may be a fluid containing heat. As it flows through tubes 32, the first fluid is in contact with tubes 32 and the heat from the first fluid transfers to tubes 32. Subsequently, because fins 36 are in thermal contact with tubes 32 and fins 36 are made of a thermally conductive composite polymer, heat transfers from tubes 32 to fins 36. The more thermally conductive the fin, the more heat transfer that occurs. A second fluid comprises second fluid flow F2, which flows in spaces between fins 36. The second fluid, which contains less heat than the first fluid, is in contact with fins 36, and the heat transfers from fins 36 to the second fluid. Because fins 36 are corrugated, fins 36 have more surface area in thermal contact with the first and second fluids and a greater amount of heat transfer occurs. As such, heat exchanger 30 can be used to transfer heat from a first fluid to a second fluid, thereby cooling the first fluid and heating the second fluid. Fins 36 are used to increase surface area that is in thermal contact with the first and second fluids.

Discussion of Possible Embodiments

The following are non-exclusive descriptions of possible embodiments of the present disclosure.

A heat exchanger includes a metal tube and a composite polymer fin in thermal contact with the metal tube, the fin being formed of a polymer and a thermally conductive filler such that the fin has a thermal conductivity greater than or equal to 0.5 Watts per meter Kelvin.

The heat exchanger of the preceding paragraph can optionally include, additionally and/or alternatively, any one or more of the following features, configurations and/or additional components:

The polymer is a rigid thermoplastic polymer, an elastomeric polymer, or a copolymer.

The polymer is selected from a group consisting of: polypropylene, nylon 6, nylon 6/6, nylon 6/12, nylon 11, nylon 12, polyphthalamide, polyphenylene sulfide, liquid crystal polymers, polyethylene, polyether ether ketone, polyether ether ketone, polyether ketone ketone, fluoroelastomers, polyvinylidene fluoride, polytetrafluoro ethylene, silicones, fluorosilicones, ethylene propylene diene monomer (EPDM) rubber, and polyurethane or copolymers of these materials.

The thermally conductive filler is selected from a group consisting of: graphite, graphene, boron nitride, carbon, carbon nanotubes, carbon fiber, silicon carbide, silicon nitride, metal, and combinations thereof.

The fin has a concentration of the thermally conductive filler of greater than 5 weight percent, preferably greater than 15 weight percent, and more preferably greater than 25 weight percent.

The fin is a flat sheet.

The fin is corrugated.

A plurality of fins, wherein the fins are flat sheets arranged parallel to each other and orthogonal to the metal tube, which is annular.

A plurality of annular metal tubes arranged parallel to each other.

A plurality of fins, wherein the fins are corrugated.

A plurality of metal tubes, wherein the metal tubes are multiport extrusions and the metal tubes and corrugated fins are stacked such that they alternate.

The thermally conductive filler has a thermal conductivity greater than or equal to 2 Watts per meter Kelvin, preferably greater than 5 Watts per meter Kelvin, and more preferably greater than 20 Watts per meter Kelvin.

The fin is attached to the tube by thermoplastic force, chemical bonding, curable adhesive, or pressure fitting.

The fin is heat shrinkable and includes a perforation configured to accept insertion of the tube.

The thermally conductive filler includes particles that protrude partially from a surface of the polymer.

The metal tube includes a plurality of micro tubes.

The tube has a hydraulic diameter between about 0.2 millimeter and about 2.0 millimeters.

The polymer surfaces are hydrophobic.

The fin is coated.

A heat exchanger includes a plurality of metal tubes and a plurality of composite polymer fins in thermal contact with the metal tubes, the fins being formed of polymer and a thermally conductive filler such that the fin has a thermal conductivity greater than or equal to 0.5 Watts per meter Kelvin.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A heat exchanger comprising:

a metal tube; and a composite polymer fin in thermal contact with the metal tube, the composite polymer fin being formed of a polymer and a thermally conductive filler such that the composite polymer fin has a thermal conductivity greater than or equal to 0.5 Watts per meter Kelvin, wherein the thermally conductive filler includes particles that are partially embedded within the polymer and partially protrude from a first surface of the polymer and the first surface of the polymer is coated with a metallic coating.

2. The heat exchanger of claim 1 wherein the polymer is a rigid thermoplastic polymer, an elastomeric polymer, or a copolymer.

3. The heat exchanger of claim 1 wherein the polymer is selected from a group consisting of: polypropylene, nylon 6, nylon 6/6, nylon 6/12, nylon 11, nylon 12, polyphthalamide, polyphenylene sulfide, liquid crystal polymers, polyethylene, polyether ether ether ketone, polyether ether ketone, polyether ketone ketone, fluoroelastomers, polyvinylidene fluoride, polytetrafluoro ethylene, silicones, fluorosilicones, ethylene propylene diene monomer (EPDM) rubber, and polyurethane or copolymers of these materials.

4. The heat exchanger of claim 1 wherein the thermally conductive filler is selected from a group consisting of: graphite, graphene, boron nitride, carbon, carbon nanotubes, carbon fiber, silicon carbide, silicon nitride, metal, and combinations thereof.

5. The heat exchanger of claim 1 wherein the composite polymer fin has a concentration of the thermally conductive filler of greater than 5 weight percent, greater than 15 weight percent, or greater than 25 weight percent.

6. The heat exchanger of claim 1 wherein the composite polymer fin is a flat sheet.

7. The heat exchanger of claim 1 wherein the composite polymer fin is corrugated.

8. The heat exchanger of claim 1 and further including a plurality of the composite polymer fins, wherein the composite polymer fins are flat sheets arranged parallel to each other and orthogonal to the metal tube, which is annular.

9. The heat exchanger of claim 8 and further including a plurality of metal tubes arranged parallel to each other and in thermal contact with the plurality of composite polymer fins.

10. The heat exchanger of claim 1 and further including a plurality of composite polymer fins, wherein the composite polymer fins are corrugated.

11. The heat exchanger of claim 10 and further including a plurality of metal tubes, wherein the metal tubes are multiport extrusions and the metal tubes and corrugated composite polymer fins are stacked such that they alternate.

12. The heat exchanger of claim 1 wherein the thermally conductive filler has a thermal conductivity greater than or equal to 2 Watts per meter Kelvin, greater than 5 Watts per meter Kelvin, or greater than 20 Watts per meter Kelvin.

13. The heat exchanger of claim 1 wherein the composite polymer fin is attached to the metal tube by thermoplastic force, chemical bonding, curable adhesive, or pressure fitting.

14. The heat exchanger of claim 1 wherein the composite polymer fin is heat shrinkable and includes a perforation configured to accept insertion of the metal tube.

15. The heat exchanger of claim 1 wherein the metal tube includes a plurality of tubes formed within the metal tube between an outer diameter of the metal tube and an inner diameter of the metal tube.

16. The heat exchanger of claim 1 wherein the metal tube has a hydraulic diameter between about 0.2 millimeter and about 2.0 millimeters.

17. The heat exchanger of claim 1 wherein surfaces of the polymer are hydrophobic.

18. A heat exchanger comprising:

a plurality of metal tubes; and a plurality of composite polymer fins in thermal contact with the metal tubes, the composite polymer fins being formed of polymer and a thermally conductive filler such that the composite polymer fins have a thermal conductivity greater than or equal to 0.5 Watts per meter Kelvin, wherein the thermally conductive filler includes particles that are partially embedded within the polymer and partially protrude from a first surface of the polymer and the first surface of the polymer is coated with a metallic coating.

* * * * *